US006152083A

United States Patent [19]

Bridegum

[11] Patent Number: 6,152,083

[45] Date of Patent: Nov. 28, 2000

[54] COMPACT GAS FIRED WATER HEATER WITH IMPROVED COMBUSTION CHAMBER

[75] Inventor: James E. Bridegum, Reno, Nev.

[73] Assignee: American Standard Inc., Piscataway, N.J.

[21] Appl. No.: 09/060,542

[22] Filed: Apr. 16, 1998

[51] Int. Cl.[7] ..... F24H 1/20

[52] U.S. Cl. ..... 122/18.3; 122/87; 29/890.054

[58] Field of Search ..... 126/366, 378, 126/360.1; 122/13.1, 14, 16–19, 18.3, 87; 29/890.051, 890.054; 285/134.1

[56] References Cited

U.S. PATENT DOCUMENTS

| | | | |
|---|---|---|---|
| 2,796,860 | 6/1957 | Pinkus et al. . | |
| 3,028,843 | 4/1962 | Carlson et al. | 122/17 |
| 3,056,400 | 10/1962 | Hammersley et al. . | |
| 3,062,233 | 11/1962 | Hammersley . | |
| 3,405,690 | 10/1968 | Burrus et al. . | |
| 4,771,762 | 9/1988 | Bridegum | 122/17 |
| 5,197,415 | 3/1993 | Stretch et al. | 122/17 |
| 5,699,756 | 12/1997 | Ross et al. | 122/17 |

*Primary Examiner*—Ira S. Lazarus
*Assistant Examiner*—Sara Clarke

[57] ABSTRACT

A compact gas fired water heater is provided for recreational vehicles or the like, with higher recoveries and greater efficiencies resulting from increased heating surface and smoother flow of gases in the combustion chamber. The combustion chamber is comprised of two straight horizontal lengths of tube joined in the rear by a specially formed coupler with an additional plate between the tubes to close the front of the coupler.

2 Claims, 7 Drawing Sheets

COMPACT GAS FIRED WATER HEATER WITH IMPROVED COMBUSTION CHAMBER

BACKGROUND OF THE INVENTION

1. Field of the Invention

This invention relates generally to an improved compact gas fired water heater for installation in recreational vehicles. Specifically this invention relates to a gas fired water heater of compact size with an improved combustion chamber that offers manufacturing, dimensional, cost and performance advantages over water heaters of this type currently available for such installations.

2. Description of the Related Art

While combustion chambers of various designs and configurations have been invented and used for furnace and other space heating applications, the methods employed over the years for combustion chambers for water heaters for the recreational vehicle market has been limited to direct vent type designs to meet rigid space limitations, test pressure requirements mandated by various regulatory codes, and design methods that will offer the most economical products to the RV manufacturer and the consumer. Consequently water heaters for recreational vehicles continue to be made with direct vent type combustion chambers employing either bent tubes that permit the inlet and outlet ends of the tube to both be positioned on the front of the water heater, or a larger diameter straight horizontal tube, closed at the rear, wherein gases enter the lower front half and exit the upper front half of the horizontally positioned tube.

With the bent tube type combustion chambers utilized in many RV water heater tanks today, hot gases are injected by a burner into an entrance of a tube in the lower portion of the water heater and exit the other end of the same tube in the upper portion of the water heater. Both ends, the entrance and exit, are positioned in front of the water heater, consequently the fronts of such water heaters must be large enough to accommodate the "U" shaped bend in the tube between the entrance and the exit. Due to the large radius required to made the "U" shaped bend without distorting the tube, the dimensions of such water heaters must be either wider or higher than a water heater employing the single straight tube type construction.

While water heaters utilizing a single horizontal tube type heat exchanger may have smaller width or height dimensions in front of the water heaters than water heaters made with bent tube type combustion chambers, they have other disadvantages. In this method of design, the products of combustion pass through the lower portion of the horizontal tube below an internal median divider that extends approximately four fifths of the way from the front to the back of the tube. The gases make a turn in the rear of the tube as they make contact with the rear closure plate, whereby they then move upward and exit through the top portion to the tube above the entrance. This construction while permitting compactness, has severe limitations in performance due to the slowing down of the movement of the hot gases resulting from the abrupt turn in back of the tube as well as the large internal diameter of the tube, generally 4½" in the water heaters being offered today. A smaller tube diameter used in the same manner, while speeding up the flow of gases by having less internal area, would at the same time be ineffective since the total amount of heating surface making contact with the water would also be reduced accordingly, and in general, even the water heaters with the 4½" diameter tubes have heating surface limitations below that of water heaters using bent tubes with separate inlets and outlets. In addition the total travel distance of the hot gases permitted with the straight horizontal tube type construction is also considerably less than the distance of travel within a combustion chamber that utilizes a separate inlet and outlet, and this further restricts the efficiency of such water heaters.

In a more recent invention, a combustion chamber is employed for compact water heaters that does not utilize a tube of any kind. This combustion chamber, similar to those used in furnaces in earlier inventions, utilizes two shell shaped halves welded together to form an internal flow pattern within a tank. While meeting the pressure requirements mandated for water heaters, this type of construction has several disadvantages inhibiting its use. Due to the large perimeters of the two halves utilized in its construction, a considerable amount of increased welding is required to weld the two halves together. In a typical water tank for a water heater of this type, the total amount of welding required for the tank is increased by approximately 20 to 25 percent. In the case of a glass lined tank, the increase in the area of the welded surfaces inside the tank, requires that additional cathode protection in the form of a larger anode be provided, further increasing the cost of the water heater to the consumer. Further, to insert the front of this type of combustion chamber into the front head of the water heater tank prior to welding, a large hole consisting of two circular holes joined together in the center with an additional narrow hole is required. This type of fabrication makes it difficult to perform automatic welding since the surfaces where the front head and combustion chamber come in contact are on different radiuses. Fit up problems between the head and combustion chamber complicate the problem even further, since minor variances in the size of the dimensions of the welds in the areas on the combustion chamber that must protrude through the tank head can result in either the combustion chamber not fitting through the pierced holes in the head, or a loose fit in the head which in turn makes it impossible to weld the combustion chamber successfully into the head with automatic welding.

A need therefore exists for a water heater with a combustion chamber design that will enable the water heater to meet the smallest front dimensional requirements for small compact water heaters for recreational vehicles, permit the best possible economies by reducing the total amount of welding required, permit fully automatic welding of the combustion chamber into the tank head, insure long tank life in the case of glass lined tanks without adding additional anode surface, and at the same time enable the water heater to obtain a higher recovery and better efficiency than water heaters of this type currently available to the consumers.

The present invention fulfills this need and provides further related advantages.

Various methods and designs have been used for combustion chambers over the years, most of which were used for furnace and other types of space heating applications. None of the referenced patents or prior art reveals or suggests a combustion chamber which is fabricated by inserting and welding two lengths of tubing into a coupler to make a smaller radius turn than could otherwise have been made by a bend, and then in turn mounting the combustion chamber horizontally into the tank by inserting the two opposite ends of the tubing through the front head of the tank and welding them into position. These prior art references are:

| U.S. PAT. NO. | INVENTOR |
|---|---|
| 4,771,762 | Bridegum |
| 3,405,690 | Burrus et al. |
| 3,062,233 | Hammersley |
| 3,056,400 | Hammersley et al. |
| 2,796,860 | Pinkus et al. |

SUMMARY OF THE INVENTION

In accordance with the invention an improved combustion chamber is provided for compact gas fired water heaters for recreational vehicles that will permit the water heater to meet the minimum size front dimensional requirements for water heaters of this type and at the same time have an increased amount of heating surface and travel distance for the hot gases moving within the combustion chamber.

Another object of the invention is to permit the water heater to obtain higher BTU inputs and larger quantities of hot water than similar water heaters available today.

A further object of the invention is to permit the water heater to operate with greater efficiencies.

Still a further object of the invention is to provide an improved combustion chamber with smoother surface areas that are more suitable for glass coatings when used in conjunction with steel tanks.

Yet another object of the invention is to provide an improved design that will pass mandated hydrostatic test pressures of 300 PSI without increasing the thickness of the material used in the fabrication. With this invention, both the tubes and coupler can be the minimum gauges permitted by the standards.

A further object of the invention is to provide a design that will allow all welds to be performed automatically on flat surfaces minimizing the cost of the welding equipment while at the same time insuring better quality welding.

Still a further object of the invention is to reduce the total amount of welding surface, and welding time and material, required in the fabrication of the combustion chamber.

The novel features which are believed to be characteristic of the invention, both as to design and method of use, together with further objects and advantages will be better understood from the following description, considered in conjunction with the accompanying drawings in which the preferred embodiments of the invention are illustrated by way of example. It is expressly understood however, that the drawings are for the purpose of illustration and description only and are not intended as a definition of the limits of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
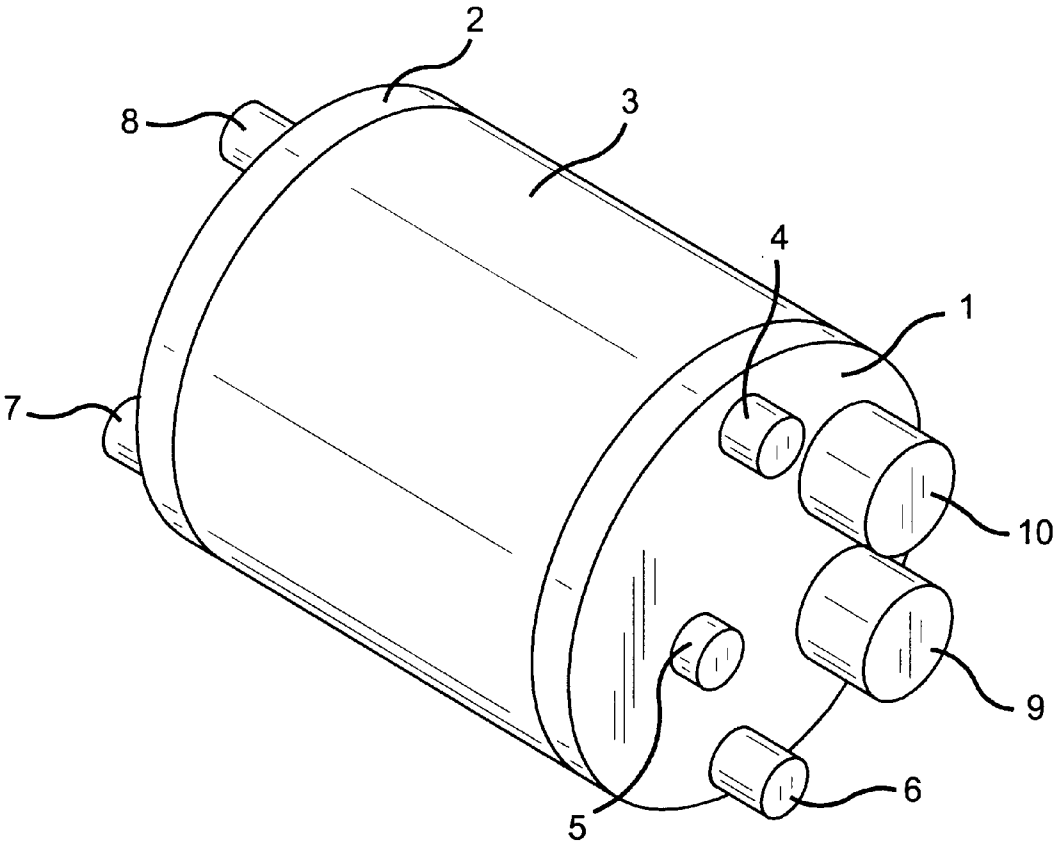
FIG. 1 is a perspective view of a small compact water heater tank with the preferred embodiment used in a water heater for recreational vehicles.

As shown in the exemplary drawing FIG. 1, a water heater tank is provided that is constructed with the following basic parts: namely a front head 1, a rear head 2, a tank sheet 3, a coupling for a temperature and pressure relief valve 4, a thermostat coupling 5, a drain coupling 6, a cold water inlet coupling 7, a hot water outlet coupling 8, a combustion chamber inlet opening 9, and a combustion chamber outlet opening 10.

Figure 2:
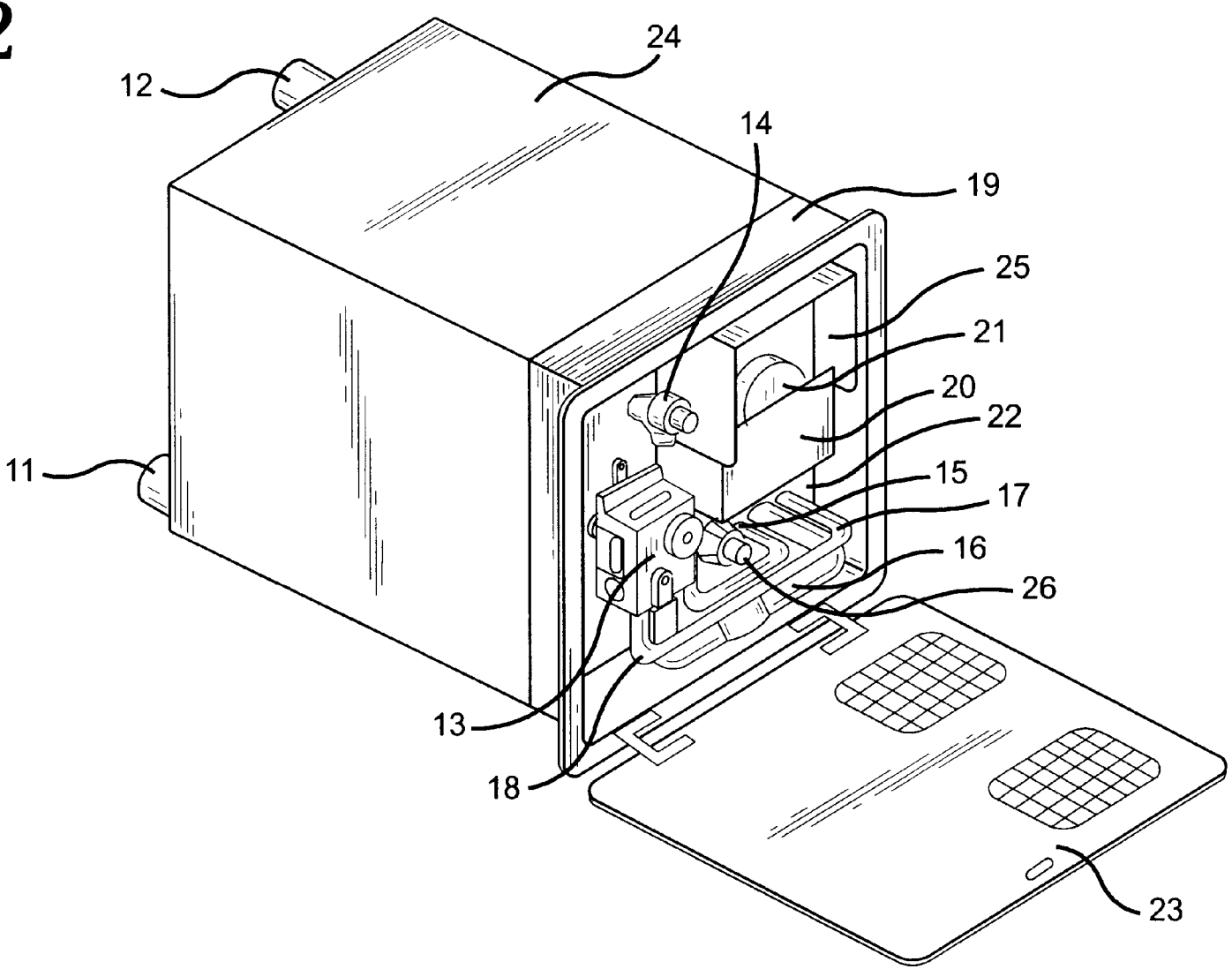
FIG. 2 is a perspective view of a complete small compact water heater utilizing the preferred embodiment.
Figure 3A:
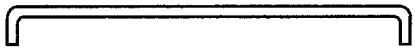
FIGS. 3, 3A and 3B are front elevational, side elevational, and bottom plan views, respectively, of the center plate used between the two lengths of tubing in the coupler used in the preferred embodiment.
Figure 3:
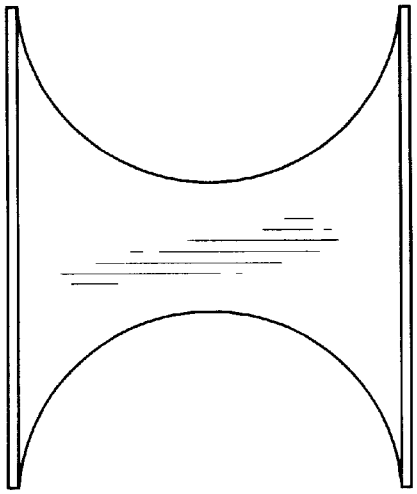
Figure 3B:
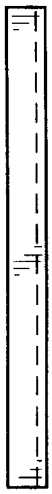

The tank shown in FIG. 1, is fabricated into a small compact water heater FIG. 2, with a casing 24, covering insulation that surrounds the tank, and a front control housing 19, with a hinged door 23, enclosing the various components in the front of the water heater. In the preferred embodiment, a burner 16, is positioned in the entrance of the combustion chamber 22, to receive gas from a combination thermostat/gas valve 13, through a manifold 18. Ignition to the burner 16, is accomplished by a pilot 17, in conjunction with a thermocouple 15, or in other models, with an electrode and spark ignition module in conjunction with a gas valve and thermostat. Once ignition is established the hot gases flow rapidly through the combustion chamber and exit at the combustion chamber outlet 21. An appropriate wind shield 20, and heat shield 25, are also located inside the control housing along with a drain 26, and a temperature and pressure relief valve 14. A cold water inlet 11, and a hot water outlet 12, are provided on the back of the water heater, along with a fitting for an anode (not shown), if steel glass lined tanks are employed.

Figure 4A:
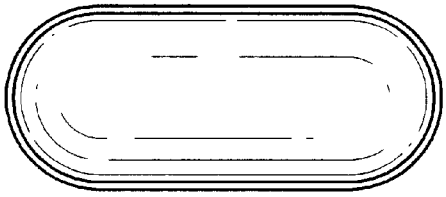
FIGS. 4, 4A and 4B are front, side, and top views, respectively, of the coupler used to receive and join the two lengths of tubing used in the preferred embodiment.
Figure 4B:
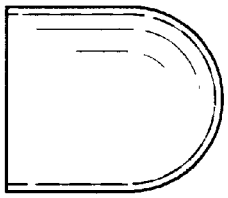
Figure 4:
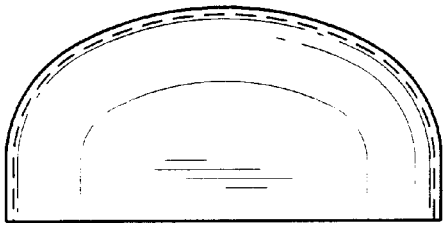
Figure 5A:
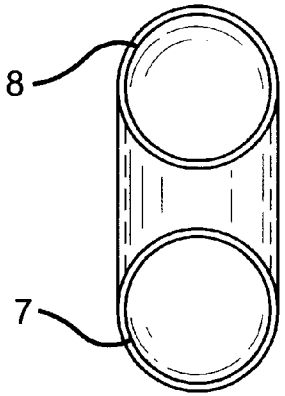
FIGS. 5 and 5A are side and front views, respectively, of the assembled combustion chamber of the preferred embodiment.
Figure 5:
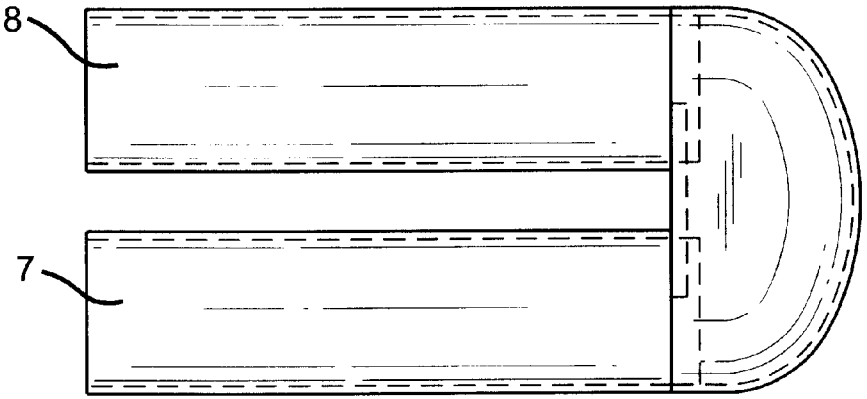

Importantly, the unique combustion chamber, FIGS. 5 and 5A, provides a maximum number of square inches of heating surface, approximately 25 percent more surface than water heaters of this type currently available with similar front dimensions. At the same time the area of the passageway is small enough to enable gases to move more rapidly than water heaters employing larger diameter straight horizontal tube combustion chambers. The novel design of the coupler, FIGS. 4, 4A and 4B insures that the gases will flow smoothly and rapidly around the turn in the rear of the combustion chamber further increasing efficiency, as well as recovery.

Figure 6A:
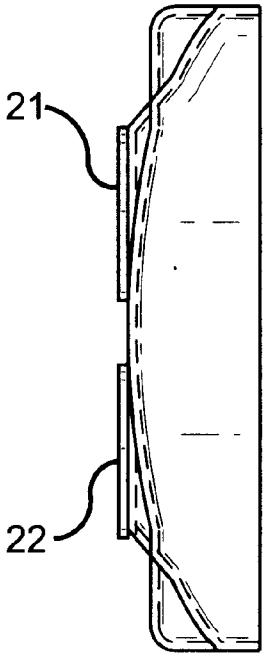
FIGS. 6 and 6A are front and side views, respectively, of the front head of the water heater tank showing the flat embossed area where the combustion chamber is welded to the head.
Figure 6:
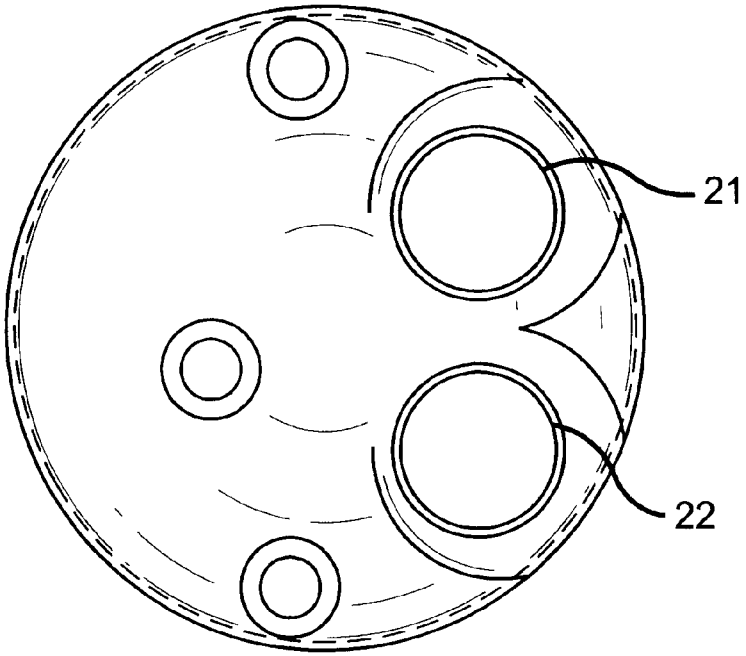
Figure 7A:
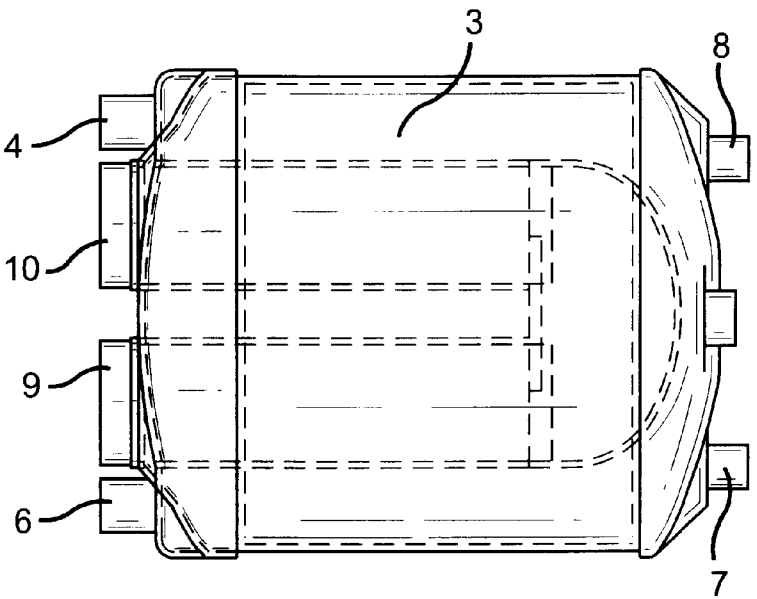
FIG. 7A is a side cross sectional view of a water heater tank showing the combustion chamber in the tank.
Figure 7:
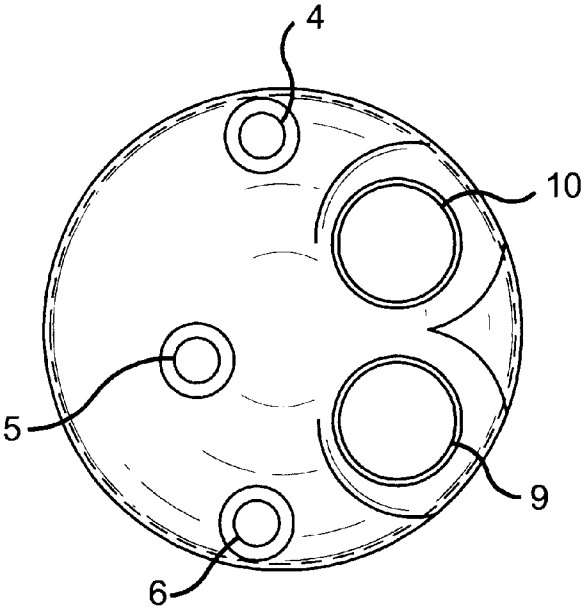
FIG. 7 is a front view of a water heater tank showing the inlet and outlet positions of the combustion chamber.

The coupler is formed readily by a single stamping to exact tolerances with the radiuses on the two ends being identical to the tube radiuses being employed. The weld, attaching the center plate to the two tubes, can be done automatically from the rear of the plate where ample space exists for the welding fixture to complete the two half circle welds. Importantly, this weld assembly, consisting of the two tubes and the center plate, can then be pressed into the coupler with a tight fit, where the unique design permits one final automatic weld around the perimeter to complete the assembly. The finished assembly, FIGS. 5 and 5A, is then attached to the tank head FIGS. 6 and 6A, by inserting the two tubes into the appropriate openings in the head, where flat embosses on the head permit the two final welds, the tubes to the head, to be quickly completed automatically with circumferential type welds. Moreover, the entire assembly requires considerable less welding time and less welding material than a combustion chamber made with two shell shaped halves. Additionally the invention provides considerable more heating surface, and a subsequent increase in recovery of up to 40 percent more for a small compact water heater, than that provided by a combustion chamber employing a single horizontal tube.

The foregoing detailed description is illustrative of the embodiments of the invention and it is to be understood that additional embodiments thereof will be obvious to those skilled in the art. The embodiments described herein, together with those additional embodiments are considered to be within the scope of the invention.

What is claimed is:

1. A gas fired water heater for a recreational vehicle comprising:

a tank for receiving and storing water;

an internal combustion chamber within said tank consisting of two horizontal tubes each having a rear end and being mounted in holes in a front head of the tank, and a coupler joining the tubes at their rear ends so that the chamber forms a "U" shape enabling hot gases from a burner to enter and exit at a front side of the tank and water heater;

a means for supplying fuel and ignition to the gas burner; and a means for introducing cold water into a lower portion of the tank so that hot water will exit from an upper portion of the tank to supply hot water to various hot water outlets within the recreational vehicle;

wherein said coupler in the combustion chamber is made from a single piece of formed metal with an opening cross section having two end arcs formed to receive the outside halves of the tubes, the end arcs and the tubes having the same radius, and a plate with punched through openings to receive the inside halves of the tubes, said plate being subsequently welded between the two tubes to form a tube and plate assembly, wherein the tube and plate assembly is then pressed and welded into said coupler, and wherein the holes on the front head for receiving the combustion chamber tubes have flat embosses to facilitate welding of the tubes to the head.

2. A gas fired water heater for a recreational vehicle comprising:

a tank for receiving and storing water;

an internal combustion chamber within said tank consisting of two horizontal tubes each having a rear end and being mounted in holes in a front head of the tank, and a coupler joining the tubes at their rear ends so that the chamber forms a "U" shape enabling hot gases from a burner to enter and exit at a front side of the tank and water heater;

a means for supplying fuel and ignition to the gas burner; and a means for introducing cold water into a lower portion of the tank so that hot water will exit from an upper portion of the tank to supply hot water to various hot water outlets within the recreational vehicle;

wherein said coupler in the combustion chamber is made from a single piece of formed metal with an opening cross section having two end arcs formed to receive the outside halves of the tubes, the end arcs and the tubes having the same radius, and a single plate larger than a front of the coupler with two punched through holes, the holes having the same radius as the end arcs of the coupler, wherein the two tubes are inserted and welded into said plate to form a plate and tube assembly, and said plate and tube assembly is then placed against and welded to the coupler with the tubes matching or fitting into the two end arcs of the coupler, and wherein the holes on the front head for receiving the combustion chamber tubes have flat embosses to facilitate welding of the tubes to the front head.

* * * * *